United States Patent [19]

Lattanzi

[11] 4,035,054

[45] July 12, 1977

[54] COAXIAL CONNECTOR

[75] Inventor: Ernest W. Lattanzi, Melrose, Mass.

[73] Assignee: Kevlin Manufacturing Company, Woburn, Mass.

[21] Appl. No.: 637,935

[22] Filed: Dec. 5, 1975

[51] Int. Cl.[2] ..... H01R 17/04

[52] U.S. Cl. ..... 339/177 R; 339/278 C

[58] Field of Search ..... 339/136 R, 136 C, 177 R, 339/177 E, 178, 278 C

[56] References Cited

U.S. PATENT DOCUMENTS

| | | | |
|---|---|---|---|
| 3,199,061 | 8/1965 | Johnson | 339/177 R |
| 3,372,364 | 3/1968 | O'Keefe | 339/177 R |

FOREIGN PATENT DOCUMENTS

| | | | |
|---|---|---|---|
| 723,084 | 2/1955 | United Kingdom | 339/177 R |

*Primary Examiner*—Roy Lake
*Assistant Examiner*—Mark S. Bicks
*Attorney, Agent, or Firm*—Robert F. O'Connell

[57] ABSTRACT

A coaxial connector particularly adaptable for use as a miniature or sub-miniature connector at relatively high frequencies up to 40 GHz and above, which utilizes an inner contact assembly comprising a center conductor member which is retained within a dielectric member which is in turn retained within a conductive insert member, such assembly being positioned within a housing so that the center conductor extends beyond the dielectric and the conductive insert member coaxially of the interior of the housing. Conductive ring members are positioned adjacent each end of such assembly to fixedly hold the assembly at a predetermined position within the housing to prevent axial movement of the center conductor member therein. The diameters and lengths of the above members are selected to provide substantially matched impedance characteristics over the length of the coaxial connector.

12 Claims, 7 Drawing Figures

COAXIAL CONNECTOR

INTRODUCTION

This invention relates generally to coaxial connectors for connecting to coaxial cables and, more particularly, to coaxial connectors of the miniature and sub-miniature type for use at relatively high frequencies.

BACKGROUND OF THE INVENTION

Miniature and sub-miniature connectors, as utilized at the present time, generally comprise a threaded outer conductor shell which is normally made from stainless steel and a center conductor of the spring finger collet type, normally manufactured from a suitable highly conductive material such as beryllium copper, and a dielectric bead support for the center conductor which extends the length of the spring finger center conductor collet. An example of such a structure is shown in U.S. Pat. No. 3,147,057 of Collusi, issued Sept. 1, 1964.

At least two problems arise with regard to the structural operation of connectors of the type shown in the above referred to patent. First of all, the outer conductor shell of the connector, which is made from stainless steel, has lossy characteristics at the RF signal frequencies for which such connectors are often used and, consequently, the signal insertion losses thereof are undesirably high, particularly at higher frequencies. In order to counteract such insertion losses at higher frequencies, the conductive shell, manufactured from stainless steel, is plated with a precious metal such as gold, or silver, or a combination thereof in order to increase the conductivity thereof and to negate the lossy RF characteristics. Plating of the stainless steel with precious metals to improve the loss properties at higher frequencies has a tendency to flake off at the interface as a result of the inter-connect with the mating connector. The fine particles of precious metal which flake off become deposited on the dielectric interface causing a deterioration in RF performance. Because of the mechanical problems and expense associated with such plating of the outer conductive shell with a soft precious metal, manufacturers often omit the plating material so that the unplated shell, having increased transmission line losses especially at higher frequencies, becomes less effective in applications requiring low insertion loss over a wide range of frequencies.

Secondly, in the construction shown in the Collusi patent, the dielectric bead therein tends to move within the outer conductor shell, the position of the center conductor collet thereby moving axially in connector. Such a shift in position of the center conductor and the dielectric bead results in improper mating and orientation of coaxial cable components and produces undesirable electrical discontinuities which result in unwanted reflections of the transmitted signal.

In order to avoid the axial movement of the dielectric bead and, hence, of the center conductor, manufacturers have utilized a structure in which a plastic pin extends from the outer conductor shell through the dielectric bead to a region where it mechanically engages with the center conductor collet. Such structures, for example, are shown in U.S. Pat. No. 3,292,117 of Bryant et al., issued on Dec. 13, 1966. Thus, captivation of the spring finger center conductor collect occurs either through, or around, an annular groove which is cut into the center conductor member as shown therein.

Because of the shear strength and other mechanical properties which are required in order to enhance the life of the threads on the outer conductor shell, which shell has a relatively thin cross-section, stainless steel is normally used for such outer conductive shell. Accordingly, the stainless steel shell is normally plated with a precious metal in order to increase the conductivity of the inner diameter transmission line path thereof and to reduce the transmission line losses. As discussed above, such precious metal plating tends to be removed, or to flake off, as interconnections are continuously made and un-made between the connector and the coaxial cable with which it is mated. The precious metal also tends to become deposited on the dielectric interface between the coaxial cable and the connector thereby causing further deterioration in the performance of the connector at the frequencies normally of interest in miniature and sub-miniature connector applications. If the precious metal plating is omitted, unsatisfactory insertion loss characteristics arise, which losses, as discussed above, tend to increase as the frequencies of the transmitted signals increase.

Further, operation of such connectors at high temperatures causes an expansion of the dielectric support member so that it tends to extend beyond the shoulder formed at the end of the threaded outer conductor shell and causes improper connector mating interface operation, again resulting in poor performance at the desired frequencies of operation. The presence of the plastic pin which, for example, may be made of an epoxy plastic causes a discontinuity to occur within the frequency range of interest due to the undercutting of the spring finger center conductor collet where it engages therewith. Further, differences in the dielectric constant of the epoxy pin material and the dielectric bead support material (usually made of Teflon) cause further RF discontinuities to be present. Moreover, it has been found that the threaded conductor shell opening, the center conductor member undercut portion and the epoxy pin material all tend to resonate at random frequencies so as to cause further RF signal discontinuities and distortions. Because of the presence of the epoxy pin, the strength of the outer conductor shell and the center conductor is decreased, particularly when used in miniature and sub-miniature connectors in which the diameters are relatively small. Since the shear strength of the epoxy material is much less than that of stainless steel, the strength of the overall structure is accordingly reduced.

Efforts to avoid the use of an epoxy pin structure or equivalent have been suggested as in U.S. Pat. No. 3,372,364 of O'Keefe et al., issued on Mar. 5, 1968. In the O'Keefe structure a pair of ring members are wedge fitted within the outer conductor shell on either side of a dielectric insert member which holds the center conductor member so that the dielectric insert is effectively captured therebetween and prevented from moving axially within the outer conductor shell. The dielectric insert extends from the center conductor member to the outer conductor shell. The use of such ring members causes a discontinuity at the interface thereof with the dielectric insert and, hence, gives rise to undesired reflections of the transmitted signals thereat. Further, the use of that portion of the outer shell in contact with the dielectric insert as the outer conductor of the connector produces transmission losses particularly at the high frequencies of operation that are desired in miniature and sub-miniature connectors, which losses can only be counteracted by plating the interior surface of the outer conductor shell with a precious metal as discussed above.

Moreover, when coaxial cables are mated with the connector of O'Keefe et al., pressure differences can occur across the dielectric insert which tend to distort the shape thereof and cause further changes in the signal transmission properties, which changes can cause reflections in the transmitted signal particularly at high frequencies.

In summary, both the Bryant design and O'Keefe design have inherent characteristics which are detrimental to high frequency operation. In the Bryant design, because the dielectric bead support runs the entire length of the center conductor spring collet, the cross sectional dimensions which are chosen consistent with the dielectric constant of the bead support and consistent with the inter-connect dimensional requirements, the maximum theoretical operating frequency is limited to approximately 35 GHz.

The O'Keefe design has several inherent characteristics which tend to be undesirable for high frequency operation and preclude interface with present "state of the art" plug connectors. Thus, plating of the outer shell is required and, because the inner diameter of the outer shell is used as the transmission line path, it is not feasible to select cross sectional interface diameters which can adapt to state of the art sub-miniature connectors.

BRIEF DESCRIPTION OF THE INVENTION

The invention overcomes the disadvantages of present state of the art miniature and sub-miniature connectors by providing a connector with greatly reduced transmission losses in comparison therewith and greatly reduces reflections of the transmitted signal due to impedance mismatches within the connector. The connector of the invention is capable of providing satisfactory operation at relatively high frequencies up to 40 GHz and above, with a relatively low voltage standing wave ratio (VSWR) (1.25:1 max.) over the entire frequency range from 0 to up to 40 GHz and above, together with relatively low insertion losses less than about 0.25 db over such frequency range.

In accordance therewith, the invention utilizes an outer housing member and a center conductor member which is retained within a dielectric support member, the dielectric support member being retained within a conductive insert member so that the combination of the conductive insert member, together with the dielectric support member and the center conductor member form an inner contact assembly. The inner contact assembly is thereupon positioned within the outer housing at a preselected position therein so that the center contact member extends beyond the ends of the dielectric member and the insert member coaxially with the interior of the outer housing. Conductive ring members are each fixedly positioned within the housing so as to abut the ends of the inner contact assembly, the inner diameters of the ring members being smaller than the outer diameter of the dielectric member (and, hence, smaller than the inner diameter of the conductive insert member) so that the inner contact assembly is fixedly held at the preselected position within the housing member to prevent axial movement of the center conductor member therein.

The invention can be described in more detail with the help of the accompanying drawings wherein FIG. 1 depicts a view in longitudinal cross-section of a preferred embodiment of the coaxial connector of the invention;

FIGS. 4A and 4B depict graphs showing a comparison of the insertion loss and VSWR characteristics of an exemplary embodiment of the invention and of an exemplary prior art device;

Figure 1:
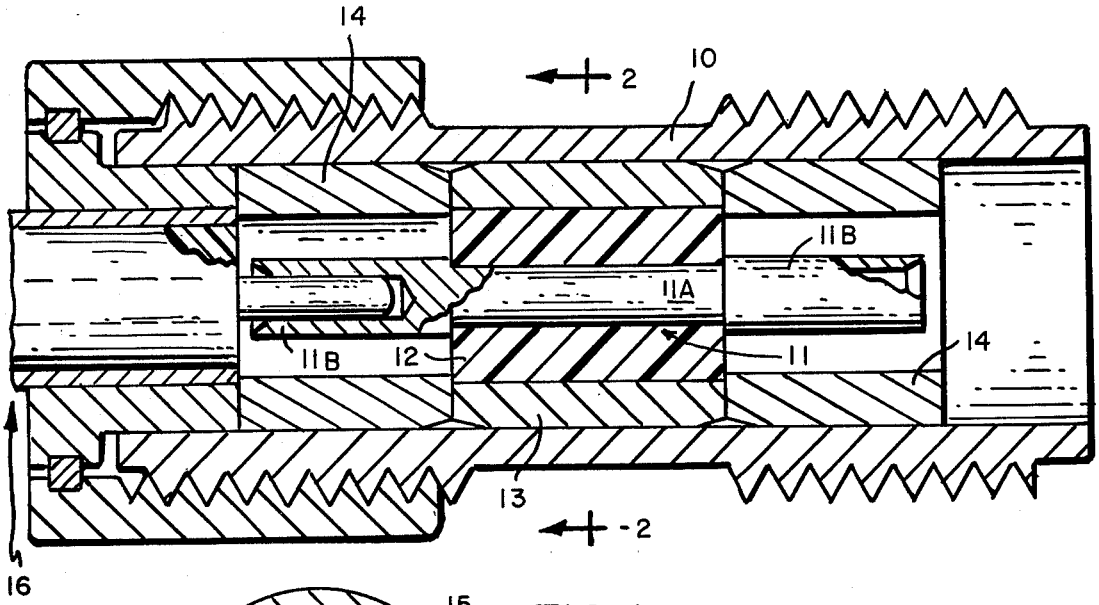

A preferred embodiment of the invention as shown in the figures depicts a coaxial connector in which a center conductor member, which is retained within a dielectric bead support member in turn retained within a conductive insert member is completely captivated within a threaded outer housing with precise coaxial concentricity so that substantially no axial motion of the center conductor member relative to the outer housing can occur. As can be seen in FIG. 1, the coaxial connector shown therein utilizes a threaded outer housing 10 which is adapted for mechanical engagement with a coaxial cable in accordance with conventionally used cables and connectors known to the art. A center conductor member 11 is retained within a dielectric support member 12, the central portion 11A of the center conductor member 11 within said dielectric support member having a reduced diameter and the spring finger conductor elements 11B at each end extending beyond the ends of the dielectric support, as shown. The dielectric support member 12 is further retained within a conductive insert member 13 within outer housing 10. The center conductor member 11, the dielectric support member 12 and the conductive insert member 13 form an inner contact assembly positioned at a preselected location within the outer housing.

A pair of conductive ring members 14 are positioned at each end of the inner contact assembly so as to abut the end surfaces of dielectric support member 12 and conductive insert member 13, as shown. Conductive ring members 14 extend from such end surfaces of the inner contact assembly substantially along the length of the spring finger conductor elements 11B, of center conductor member 11. The outer ends of ring members 14 abut the mating surface of a conventional coaxial cable plug connector 16 as shown in FIG. 1.

The inner diameter of conductive ring members 14 is slightly smaller than the outer diameter of dielectric support member 12 and when the ring members are press-fit into the outer housing 10, the inner contact assembly is thereby completely captivated within the outer housing and axial movement thereof is prevented.

While the outer housing member may be made of stainless steel to provide adequate strength, particularly for miniature and sub-miniature connectors having relatively small diameters, the conductive insert member 13 and conductive ring members 14 may be made of a highly conductive material, such as beryllium copper. Because the inner diameters of the conductive ring members 14 and the inner diameter of conductive insert member 13 differ only slightly, the impedance discontinuity at the interfaces thereof is relatively small, and reflected waves reduced considerably over that provided by the prior art. The use of conductive insert member 13 and conductive ring members 14 also avoids the necessity for plating the inner surface of the outer housing as the outer housing 10 is not required to be used as the outer R.F. conductor of the overall coaxial connector, the function of the outer conductor being served by the conductive insert member 13 and the conductive ring members 14 all of which can be fabricated from beryllium copper, or other suitable highly conductive material. Because the inner ends of ring members 14 abut directly against the outer ends of insert member 13, no pressure differential occurs across the dielectric support member 12 and, accordingly, the latter element does not experience distortions during use over wide temperature variations and discontinuities which could be caused thereby are prevented.

Figure 2:
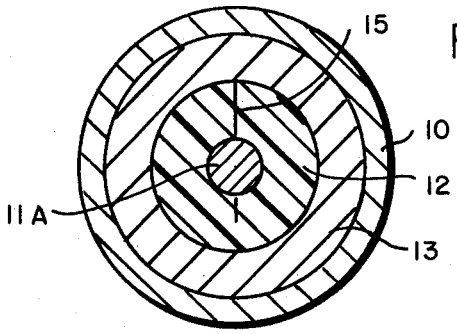
FIG. 2 depicts a view in vertical cross-section along the lines 2—2 of FIG. 1.
Figure 3:
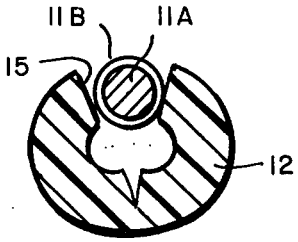
FIG. 3 depicts a view in vertical cross-section of the dielectric support member and center conductor member of the coaxial connector of FIGS. 1 and 2.

The dimensions of the elements of the connectors shown in FIGS. 1–3 are selected to provide operation over a desired extended frequency range (e.g., from 0 Hz to above 40 GHz) and to optimize the impedance match of the device so that impedance mis-matching is minimized between sections thereof from 0 to 40 GHz. In accordance with such desires the diameter of the spring finger inner conductor element 11B are selected to permit engagement and disengagement with the inner conductor of a conventional coaxial cable and the ratio of the outer diameter of the elements 11B to the inner diameter of the ring members 14, using air as the dielectric therebetween, is selected to set the frequency cut-off of transmission therethrough at a point above the desired value at the high end of the frequency range (e.g., 40 GHz). In a similar manner, the ratio of the outer diameter of the central portion 11A of center conductor member 11 to the inner diameter of conductive insert member 13, using the dielectric support member 12 (e.g., Teflon) as the dielectric medium therebetween, is selected also to set the high frequency transmission line cut-off wavelength above the high end of the frequency range. In a particular embodiment designed to provide such cut-off above 40 GHz, for example, the diameter of central portion 11A with the dielectric support member is reduced in comparison with the diameter of elements 11B with air as the dielectric.

Further, the lengths of each of the sections of the connector (i.e., the lengths of ring members and elements 11B in the outer sections and the lengths of conductive insert member 13, dielectric support member 12, and the central portion 11A of the inner section) are selected so that the impedance match from one section to another is optimized over the band width 0– 40 GHz.

In a typical coaxial connector structure of the type shown in FIGS. 1–3, for use over a frequency range from 0 Hz to 40 GHz, the inner diameters of ring members 14 were selected as 0.078 inches, the outer diameters of spring finger elements 11B of center conductor member 11 were selected as 0.0348 inches, the outer diameter of the central portion 11A of center conductor member was selected as 0.026 inches, and the inner diameter of conductive insert 13 was selected as 0.086 inches. The lengths of the members 14 and spring finger elements 11B were selected as 0.106 inches while the lengths of conductive insert member 13 and central portion 11A were selected as 0.136 inches. Such dimensions have been selected to assure an optimum impedance match over the entire frequency range of interest as discussed with reference to FIGS. 4A and 4B.

Figure 5:
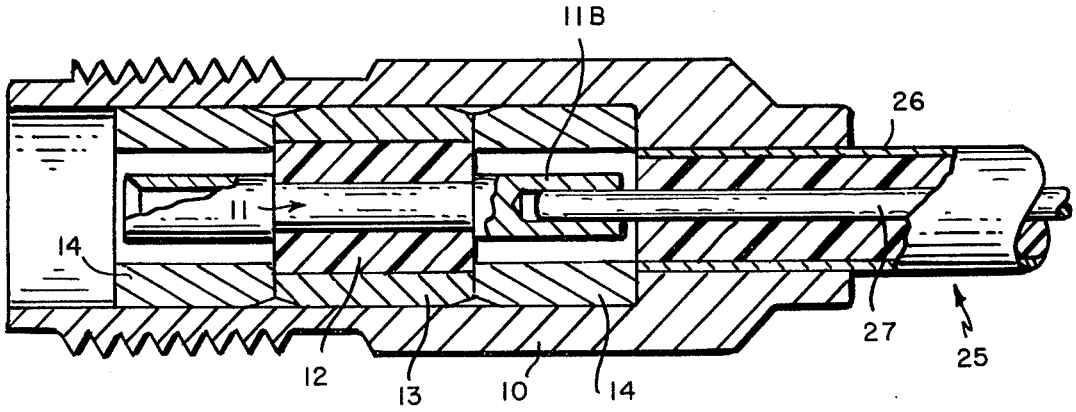
FIG. 5 depicts a view in longitudinal cross-section of an alternative embodiment of the invention.
Figure 6:
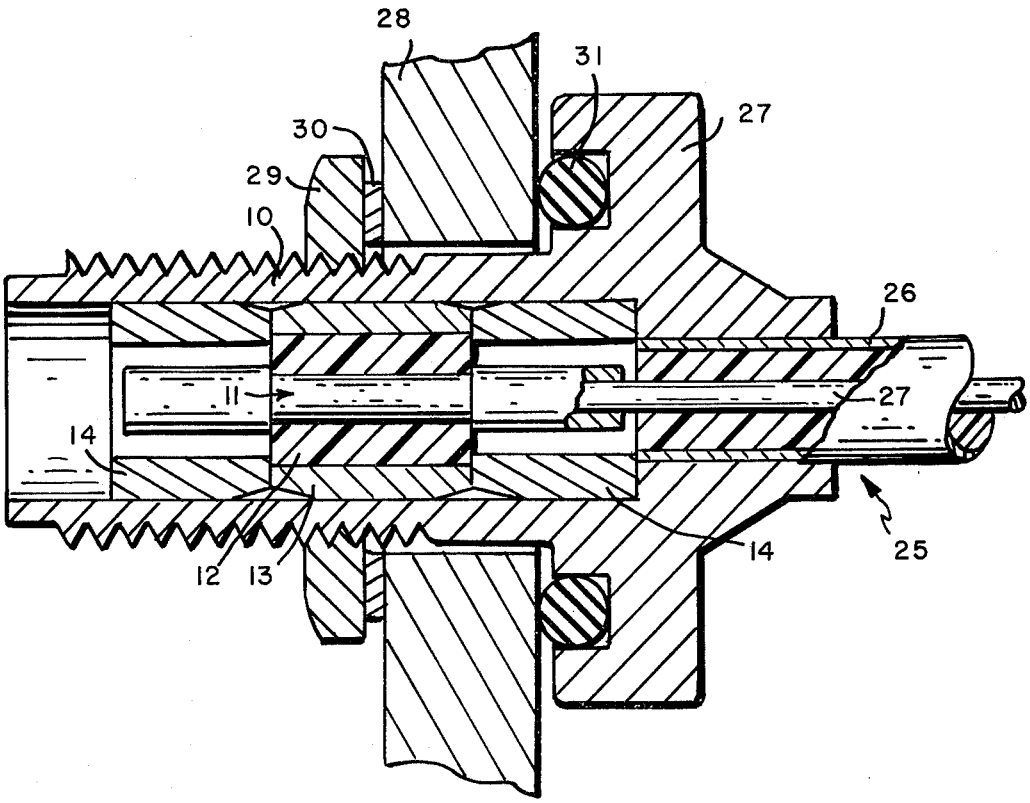
FIG. 6 depicts a view in longitudinal cross-section of another alternative embodiment of the invention.

The use of air as the dielectric between ring members 14 and spring finger elements 11B is preferred in the connector of the invention because it permits the diameters and lengths thereof, as well as the inner diameter and length of the outer housing 10 which extends beyond such members to be selected so as to better match the dimensions of mating plug connectors and coaxial cables to which the connector as described in FIGS. 5 and 6 is to be mated. In a specific embodiment as discussed above for use with a conventional coaxial cable over the 0 Hz–40 GHz frequency range discussed above, the inner diameter of the outer housing is selected between 0.1272 and 0.1297 inches and extends 0.076 inches beyond the outer ends of ring members 14.

The dimensions chosen for this connector design as described in the preceding paragraphs permit mating of and adaptability of the connector design with present state of the art sub-miniature connectors and semi-rigid cables with a minimum impedance mismatch.

In assembling the overall coaxial connector structure, the center conductor member 11 is positioned within the dielectric support member 12, the latter member having an inside diameter which is precisely the same as the diameter of the central portion 11A of the center conductor member 11 and an outside diameter which is slightly larger than the inside diameter of insert member 13. The assembly of the center conductor member 11 into the dielectric support member can be accomplished by providing a very thin cut or incision 15 along the length of and partially through the support member substantially on its center line. FIG. 3 shows a view in section similar to that of FIG. 2 of dielectric support member 12 and the center conductor member 11 partially inserted therein. It has been found adequate to provide a thin cut which extends approximately ⅞ths, or about 85 percent, of the distance therethrough in order to provide relative ease of assembly. The dielectric support member 12 then can be readily spread apart at the cut 15 sufficiently to permit insertion of the central portion 11A of the center conductor member 11 as shown. The sub-assembly comprising the center conductor member 11 and the dielectric support member 12 is then "shrink fitted" into the conductive insert member 13, the center conductor member then being trapped and held from axial motion within the dielectric bead support.

The inner contact assembly which thereupon results is pressed into the outer housing, the "press-fit" being accomplished by maintaining the proper diametral interference between the outside diameter of the insert member 13 and the inside diameter of outer housing 10. The ring members 14 are then appropriately press-fit in to housing 10 at each end of the inner contact assembly, as shown in FIG. 1.

Figure 4B:
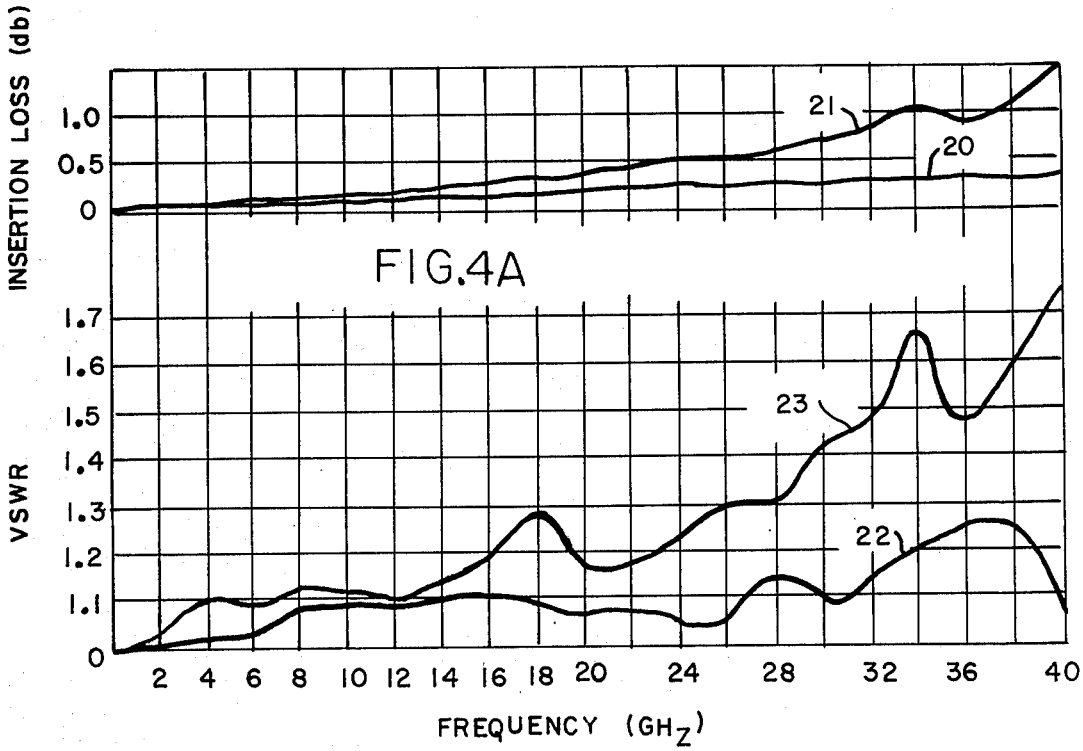

A coaxial connector in accordance with the invention, as shown in FIGS. 1–3, and having the dimensions discussed above for operation from 0 Hz to about 40 GHz has been fabricated and tested, the voltage standing wave ratio (VSWR) and the insertion loss thereof being shown for an exemplary connector in FIGS. 4A and 4B. As shown in FIG. 4A, the insertion loss measured in db is plotted as a function of frequency, the curve 20 thereof showing an increasing insertion loss from the low frequency end to the high frequency end with a maximum insertion loss slightly above 0.25 db. A comparison of such characteristics with the same characteristics as measured for an exemplary prior art device of the type, for example, shown in the Bryant et al. patent, is shown as curve 21, which indicates that the insertion loss increases at a much more rapid rate for the prior art device with a maximum insertion loss almost 3 times as high as that of the invention at the high frequency end and an even larger increase thereof in the vicinity of the frequency range of about 32 to about 36 GHz.

In FIG. 4B, curve 22 depicts an exemplary graph of the voltage standing wave ratio (VSWR) as a function of frequency and indicates that the maximum VSWR of 1.25 occurs near the high frequency end. An exemplary curve for a prior art device of the type shown in th Bryant et al. patent is depicted by curve 23, which indicates much larger standing wave ratios over substantially the entire frequency range with a maximum as high as 1.65 in the vicinity of 34 GHz. The significant improvement in both insertion loss and VSWR permit the device of the invention to be used with advantageous characteristics not achieved at high frequencies by the prior art structures.

The operation shown in the curves of FIGS. 4A and 4B are for operation in the dominant coaxial "TEM" mode over the broad frequency adaptable to hermetic sealing for pressurized components and the size thereof may vary with respect to cross-sectional diameters, axial lengths, thread size and materials, depending on the desired cut-off wave length and the frequency range over which the connector must function. The interface which the connector of the invention forms for use with coaxial cables is readily compatible with present state of the art miniature and sub-miniature RF connectors and is readily useable with semi-rigid coaxial cables of types available to the art.

While the invention has been described above with reference to feed-through connectors as shown in FIGS. 1–3, the principles thereof are readily useable with many other types of RF connectors as shown by the exemplary structures of FIGS. 5 and 6.

In the structure depicted in FIG. 5, the connector of the invention is used to provide a permanent connection at one end of a coaxial cable, for example, of the semi-rigid type, the other end being adapted for threaded engagement to a suitable coaxial cable. Thus, the inventive structure comprises the inner contact assembly, including center conductor member 11, dielectric-support member 12 and conductive insert member 13, together with ring members 14 all of which are positioned within outer housing 10 as discussed above in connection with FIGS. 1–3. In FIG. 5 a coaxial cable 25 is permanently attached to the connector. Thus, cable 25 has an outer conductor 26 which is soldered or otherwise conductively bonded to the inner surface of outer housing 10 and an inner conductor 27 which is mated with the spring finger elements 11B of inner conductor member 11. The cable 25 abuts a portion of the end of the ring members 14 as shown. The end of outer housing 10 opposite that to which coaxial cable 25 is attached has a threaded configuration substantially the same as that discussed above for the connector of FIGS. 1–3. The dimensions of the structure of FIG. 5 depend on the frequency range over which the connector is desired to operate and the relationships thereof are selected as discussed above.

FIG. 6 shows an alternative structure of the connector of the invention which can be mounted to a separate body, such as a panel, for example, for permanent connection to a coaxial cable. Thus, the interior structure of the connector is substantially as shown in FIGS. 1 and 5 (the same reference numerals being used for corresponding parts thereof) and the outer housing 10 differing in that it includes a flange member 27 which is affixed to a panel 28 by an appropriate nut 29 and washer 30, the housing being sealed at the panel by O-ring 31. The threaded portion of the outer housing 10 extends inwardly of the free end of the connector to accommodate the position of the nut for various thicknesses of panel 28.

Other alternative configurations of the connector of the invention may occur to those skilled in the art within the spirit of and scope of the invention and the invention is not to be construed as limited in its scope except as depicted by the appended claims.

The following United States patents, in addition to those specifically discussed in the text above, were found as a result of a prior art search and are herewith set forth as exemplary of the prior art:

| | | | |
|---|---|---|---|
| 2,540,012 | Salati | 3,624,679 | Ziegler |
| 2,914,740 | Blonder | 3,636,239 | Robbins |
| 2,995,388 | Morello | 3,760,306 | Spinner |
| 3,147,057 | Colussi | 3,761,844 | Reeder |
| 3,292,117 | Bryant | 3,778,535 | Forney |
| 3,350,500 | Ziegler | 3,804,972 | Gommans |
| 3,350,666 | Ziegler | 3,813,479 | Olivero |
| 3,372,364 | O'Keefe | 3,859,455 | Gommans |
| 3,445,794 | O'Keefe | | |

I claim:

1. A coaxial connector comprising a housing member adapted for mechanical engagement with a coaxial cable;

a center conductor member;

a dielectric member within which a central portion of said center conductor member is retained;

a conductive insert member within which said dielectric member and said portion of said center conductor member are retained to form an inner contact assembly, said inner contact assembly being positioned within said housing member at a preselected position therein, said center conductor member having further portions extending beyond said dielectric member and said conductive insert member coaxially of the interior of said housing member;

first and second conductive ring members fixedly positioned within said housing member adjacent each end of said inner contact assembly and out of contact with said center conductor member, the inner diameters of said ring members being smaller than the outer diameter of said dielectric member whereby said inner contact assembly is fixedly held at said pre-selected position within said housing member to prevent axial movement of said center conductor member therein.

2. A coaxial connector in accordance with claim 1 and further wherein the extended portions of said center conductor member are formed as spring finger elements for engaging an inner conductor of a coaxial cable.

3. A coaxial connector in accordance with claim 2 wherein the outer diameters and the lengths of said central portion and said extended portions of said center conductor member and the inner diameters and the lengths of said conductive insert member and said ring members are selected to provide substantially matched impedance characteristics over the length of said coaxial connector.

4. A coaxial connector in accordance with claim 3 wherein the dielectric medium present between said extended portions of said center conductor member and said ring members is air.

5. A coaxial connector in accordance with claim 4 wherein said housing member is formed of stainless steel and said ring members and said conductive insert member are formed of a material having low transmission loss characteristics.

6. A coaxial connector in accordance with claim 5 wherein said low transmission loss material is beryllium copper.

7. A coaxial connector in accordance with claim 3 wherein each end of said housing member is adapted for mechanical engagement and disengagement with a plug connector.

8. A coaxial connector in accordance with claim 3 wherein one end of said housing member is adapted for mechanical engagement and disengagement with a plug connector and the other end thereof is adapted for permanent attachment with a coaxial cable.

9. A coaxial connector in accordance with claim 3 wherein said housing member includes means for mounting said connector to a separate body.

10. A coaxial connector in accordance with claim 9 wherein said separate body is a panel and wherein one end of said housing member is adapted for engagement and disengagement with a plug connector and the other end thereof is adapted for permanent attachment with a coaxial cable.

11. A coaxial cable in accordance with claim 3 wherein said dielectric member has a thin cut extending along the length of and partially through said member substantially on the center line thereof to permit the insertion of said center conductor member for retention therein.

12. A coaxial cable in accordance with claim 11 wherein said thin cut extends to about 85 percent of the distance through said dielectric member.

* * * * *